US008549690B2

(12) United States Patent
Vasilakes et al.

(10) Patent No.: US 8,549,690 B2
(45) Date of Patent: Oct. 8, 2013

(54) FLOOR CLEANING TOOL WITH A SURROUNDING CAPTURE SHEET

(75) Inventors: Lloyd S. Vasilakes, Stillwater, MN (US); Gretchen A. Hauble, Dellwood, MN (US); Scott J. Tuman, Woodbury, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 30 days.

(21) Appl. No.: 13/001,460

(22) PCT Filed: Jun. 16, 2009

(86) PCT No.: PCT/US2009/047464

§ 371 (c)(1), (2), (4) Date: Feb. 23, 2011

(87) PCT Pub. No.: WO2010/002580

PCT Pub. Date: Jan. 7, 2010

(65) Prior Publication Data

US 2011/0146018 A1 Jun. 23, 2011

Related U.S. Application Data

(60) Provisional application No. 61/076,951, filed on Jun. 30, 2008.

(51) Int. Cl.
*A47L 13/46* (2006.01)
*A47L 25/00* (2006.01)

(52) U.S. Cl.
USPC ..... 15/104.002; 15/231

(58) Field of Classification Search
USPC ..... 15/104.002, 231, 247
See application file for complete search history.

(56) References Cited

U.S. PATENT DOCUMENTS

| | | | | |
|---|---|---|---|---|
| 51,127 | A | 11/1865 | Bacon | |
| 2,708,761 | A * | 5/1955 | Bergquist | 15/104.002 |
| 3,040,352 | A * | 6/1962 | Vian | 15/104.002 |

(Continued)

FOREIGN PATENT DOCUMENTS

| | | |
|---|---|---|
| CA | 2069062 | 5/1992 |
| CN | 2345157 | 10/1999 |

(Continued)

OTHER PUBLICATIONS

PCT International Search Report, (2009).

(Continued)

*Primary Examiner* — Randall Chin
(74) *Attorney, Agent, or Firm* — Trisha D. Adamson

(57) ABSTRACT

A floor cleaning tool is disclosed that provides for an improved method of gathering and picking up debris from the floor. In one embodiment, the floor cleaning tool has a handle, a wiping body wiping body comprised of a solid and continuous material connected at one end to the handle and a capture sheet covering the wiping body. The wiping body includes a first wiping side and a second wiping side, opposite the first wiping side wherein a length and width of the wiping body are each at least five times larger than a thickness between the first wiping side and second wiping side. The capture sheet covers the wiping body by wrapping continuously around the first wiping side and second wiping side. In one embodiment, the capture sheet includes a tacky surface outwardly facing from the wiping body.

18 Claims, 2 Drawing Sheets

(56) References Cited

U.S. PATENT DOCUMENTS

| | | | | |
|---|---|---|---|---|
| 3,054,127 | A | 9/1962 | Petsch et al. | |
| D210,997 | S | 5/1968 | Maloney | |
| 3,400,420 | A * | 9/1968 | Granville et al. | 15/104.93 |
| D227,199 | S | 6/1973 | Payne | |
| 4,083,075 | A * | 4/1978 | Hester | 15/104.002 |
| D283,176 | S | 4/1986 | Lapin | |
| 5,280,664 | A * | 1/1994 | Lin | 15/247 |
| 5,553,344 | A * | 9/1996 | Rosenkrantz | 15/104.002 |
| D384,506 | S | 10/1997 | Ferrari | |
| D406,420 | S | 3/1999 | Sin | |
| D420,774 | S | 2/2000 | Schupp | |
| 6,298,517 | B1 * | 10/2001 | McKay | 15/228 |
| 6,389,637 | B1 | 5/2002 | Hurell | |
| 6,901,622 | B2 * | 6/2005 | Thompson et al. | 15/104.002 |
| 7,047,586 | B2 * | 5/2006 | Shimada et al. | 15/104.002 |
| D548,911 | S | 8/2007 | Main et al. | |
| 7,490,383 | B1 | 2/2009 | Dean | |
| 2003/0019065 | A1 * | 1/2003 | Smith et al. | 15/247 |
| 2003/0171051 | A1 | 9/2003 | Bergsten et al. | |
| 2004/0031119 | A1 | 2/2004 | McKay | |
| 2006/0200933 | A1 | 9/2006 | McDonnell | |
| 2007/0136967 | A1 | 6/2007 | Tochacek et al. | |
| 2009/0144926 | A1 | 6/2009 | Fava | |
| 2009/0255073 | A1 * | 10/2009 | Emmons et al. | 15/104.002 |

FOREIGN PATENT DOCUMENTS

| | | |
|---|---|---|
| GB | 237986 | 8/1925 |
| GB | 2 189 983 | * 11/1987 |
| JP | 10-155714 | 6/1998 |
| WO | WO 2010/002580 A1 | 1/2010 |

OTHER PUBLICATIONS

PCT Written Opinion of the International Searching Authority, (2009).

Supplementary European Search Report, (2011).

* cited by examiner

FLOOR CLEANING TOOL WITH A SURROUNDING CAPTURE SHEET

CROSS REFERENCE TO RELATED APPLICATIONS

This application is a national stage filing under 35 U.S.C. 371 of PCT/US2009/047464, filed Jun. 16, 2009, which claims priority to Provisional Application No. 61/076,951, filed Jun. 30, 2008, the disclosure of which is incorporated by reference in its/their entirety herein.

BACKGROUND

The present invention relates to a floor cleaning tool with a surrounding capture sheet. In particular, the present invention relates to a floor cleaning tool that includes a removable capture sheet applied over the tool head.

Long handled brooms are effective at gathering dirt, dust, or debris from floors. However, a separate dust pan is necessary to pick up the debris from the floor. It can be inconvenient to have a separate dust pan to collect the debris. Also, even with sweeping the debris into the dust pan, often a small amount of the debris remains on the floor. The broom itself also can become very dirty and entangled with hair and dust.

Flat mops with removable sheets are another method of cleaning a floor. Typically, these flat mops are more suitable for dusting and are not well suited for gathering up and collecting large amounts of dirt or debris. Flat mops continually pushed across the floor. Therefore, large particles trapped between the floor and the flat mop cleaning surface can be pushed along the floor and scratch the floor.

SUMMARY

A floor cleaning tool is disclosed that provides for an improved method of gathering and picking up debris from the floor. The floor cleaning tool combines the pulling or sweeping action of a broom with the convenience of a removable capturing sheet that keeps the cleaning tool clean and contains the mess. In one embodiment, the cleaning tool can be flexed and moved across the floor like a flat mop for cleaning the floor.

In one embodiment, the floor cleaning implement has a handle, a wiping body wiping body comprised of a solid and continuous material connected at one end to the handle, and a capture sheet covering the wiping body. The wiping body includes a first wiping side and a second wiping side, opposite the first wiping side wherein a length and width of the wiping body are each at least five times larger than a thickness between the first wiping side and second wiping side. The capture sheet covers the wiping body by wrapping continuously around the first wiping side and second wiping side. In one embodiment, the capture sheet includes a tacky surface outwardly facing from the wiping body.

In one embodiment, the floor cleaning implement comprises a handle, a wiping body connected at one end to the handle and a capture sheet comprising a tacky surface. The wiping body includes a first wiping side and a second wiping side, opposite the first wiping side wherein a length and width of the wiping body are each at least five times larger than a thickness between the first wiping side and second wiping side. The capture sheet covers the wiping body by wrapping continuously around the first wiping side and second wiping side. The tacky surface of the capture sheet is outwardly facing from the wiping body.

In one embodiment, the floor cleaning implement comprises a handle, a flexible wiping body connected at one end to the handle, and a capture sheet comprising a tacky surface. The wiping body includes a first wiping side and a second wiping side, opposite the first wiping side wherein a length and width of the wiping body are each at least fives time larger than a thickness between the first wiping side and second wiping side. The capture sheet covers the wiping body by wrapping continuously around the first wiping side and second wiping side. The tacky surface of the capture sheet is outwardly facing from the wiping body.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention. The figures may not be drawn to scale.

DETAILED DESCRIPTION

Figure 1:
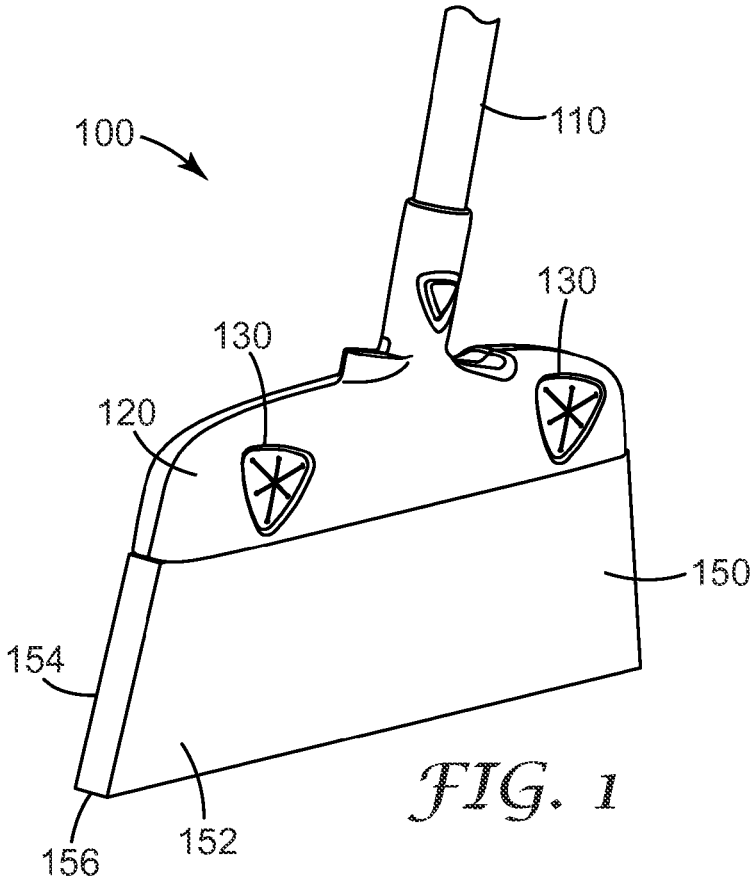
FIG. 1 is a perspective view of one embodiment of a floor cleaning implement.

FIG. 1 is a perspective view of one embodiment of a floor cleaning implement 100. The floor cleaning implement 100 includes a handle 110 and a wiping body 150. In one embodiment, the handle may include a backing 120 that provides a mechanism for connecting with the wiping body 150. For floor cleaning, the handle 100 is typically a long handle. However, in one embodiment, the cleaning implement 100 may have a short handle.

The wiping body 150 may extend directly up to the base of the handle 110. In such an embodiment, a portion of the wiping body 150 will function as the "backing" which connects the wiping body 150 with the handle. In such an embodiment, an attachment mechanism may be included directly on the wiping body 150. For example, hooks, adhesive, or mechanical fasteners may be included.

More typically, a backing 120 is included that provides a mechanism for connecting the handle 110 with the wiping body 150. The backing 120 is generally rigid and secures with the wiping body 150. The backing 120 includes an attachment mechanism for securing the capture sheet 200 (FIG. 2) to the floor cleaning implement 100. In this embodiment, the attachment mechanism is a series of securing grips 130 that are a flexible and open to pinch the capture sheet 200. The attachment mechanism may be hooks for securing with a loop of the capture sheet, may be adhesive, or may be any other type of mechanical fastener for securing with the capture sheet 200.

The handle 100 is permanently or removably connected to the backing 120. The handle 100 may thread into a receiving thread of the backing 120 or may snap-fit into the backing 120. The handle 100 may flexibly connect with the backing 120, such that when sufficient force is applied to the handle 110, the backing 120 along with the wiping body 150 flex to be parallel with the surface being cleaned. The backing 120 and handle 110 independently from one another may be made from plastic, wood, metal, or composite material that will provide structural stability to the floor cleaning implement 100.

The wiping body 150 is connected at one end to the backing 120 and is free, or unconnected, at the opposite end 156. The free end 156 is wiped across the floor to gather debris. The wiping body 150 includes a first wiping side 152 and a second wiping side 154 that is directly opposite the first wiping side 152. In one embodiment, each wiping side 152, 154 is generally planar.

The "length" of the wiping body 150 is the distance from the backing 120 to the free end 156. The "width" is the distance along the wiping body 150 that generally comes in contact along the wiping side 152. The "thickness" is the distance between the two wiping sides that comprise the width. Generally, the wiping body 150 has a fairly long length such that the cleaning implement 100 is used more often in a sweeping motion. In one embodiment, the length is at least three times the distance of the thickness. The width is typically equal to or than, up to 4 times greater than, the distance of the length. Also, the wiping body 150 is typically fairly thin so that the wiping body 150 is fairly flexible. The length and width are each at least 5 times the distance of the thickness.

In one embodiment, the wiping body 150 is a solid material. In one embodiment, the wiping body 150 is a solid and continuous material extending from the backing 120 meaning that through the length, width, and thickness of the wiping body 150 at and near the attachment to the handle, the wiping body is one, continuous material. As shown in the figures, the wiping body is entirely solid and continuous from the attachment at the backing 120 to the free end 156. In another embodiment, the wiping body is solid and continuous at the attachment at the backing 120, but removed a distance from the backing 120 the wiping body 150 may be have disconnected areas, spaces, or openings in the material. The wiping body 150 typically is flexible and conformable. In one embodiment, the solid, continuous material is able to absorb liquids. Suitable materials for the solid, continuous material include cellulose sponge or synthetic sponge. The synthetic sponge may be open cell or closed cell. Other suitable materials for the wiping body 150 include plastics that form a squeegee-like blade. In such an embodiment, the material is typically much thinner than it is wide or long. For example, the material is at least 10 times longer and 10 times wider than it is thick. Therefore, the material is very flexible and able to bend to be flat when acted upon by a force applied to the handle. A wiping body 150 that is solid and continuous material is able to gather large amounts of debris because the solid material does not allow much, if any, material to pass though during cleaning. The solid, continuous material typically has sharp edges that are able to reach into corners and pass along walls well. Also, the long and relatively think wiping body 150 is able to be inserted in to narrow openings such as between a cabinet and an appliance in a kitchen.

The stiffness of the solid, continuous material aids in gathering up the debris from the floor. The stiff material will resist against the sweeping action that a user is applying to the cleaning implement 100 and press more firmly against the surface being cleaned. In one embodiment, the sponge has a durometer (Shore 00) of at least 10. In another embodiment, the sponge has a durometer (Shore 00) of at least 20.

Exemplary materials for the wiping body 150 include all types of foam, porous rubber, silicon, synthetics, synthetic foams, formed polyester, cellulose materials, sponge materials. Specific exemplary materials or material substrates include polyether or polyester, low or high density, small, large or twin pore sizes, closed or open cell, non or flame retardant, flexible or semi rigid, plain, melamine or post treated impregnated foams, and the like. Also, neoprene, natural rubber, SBR, butyl, butadiene, nitrile, EPDM, ECH, polystyrene, polyethylene, polypropylene, EVA, EMA, metallocene resin, polyurethane, PVC, blends of any of the above, and the like. Natural sponges can be used and include those from the aquatic animal phylum Porifera, and from the dried, processed skeletons of certain species used to hold water, for example. Preferably, cellulose-based sponges can be used. Cellulose-based sponges can include those which are derived from plant products for example. More preferably, synthetic foam can be used, and even more preferably synthetic foam can be used on at least one face and polyester on at least one face. Synthetic sponges can be constructed of porous rubber, synthetic foam, other plastic and rubber derivatives, and the like, for example.

The length of the solid, continuous material, as measured from the connection with the backing 120 to the free end 156 can increase the flexibility of the wiping body. In one embodiment, the length of the wiping body 150 is less than 5 inches. In another embodiment, the length of the wiping body 150 is less than 4 inches.

In another embodiment, the wiping body 150 comprises a plurality of bristles or strips extending from the backing 120. Suitable materials for the bristles or strips include strips of cellulose sponge, synthetic sponge, or natural and/or polymeric bristles.

Figure 2:
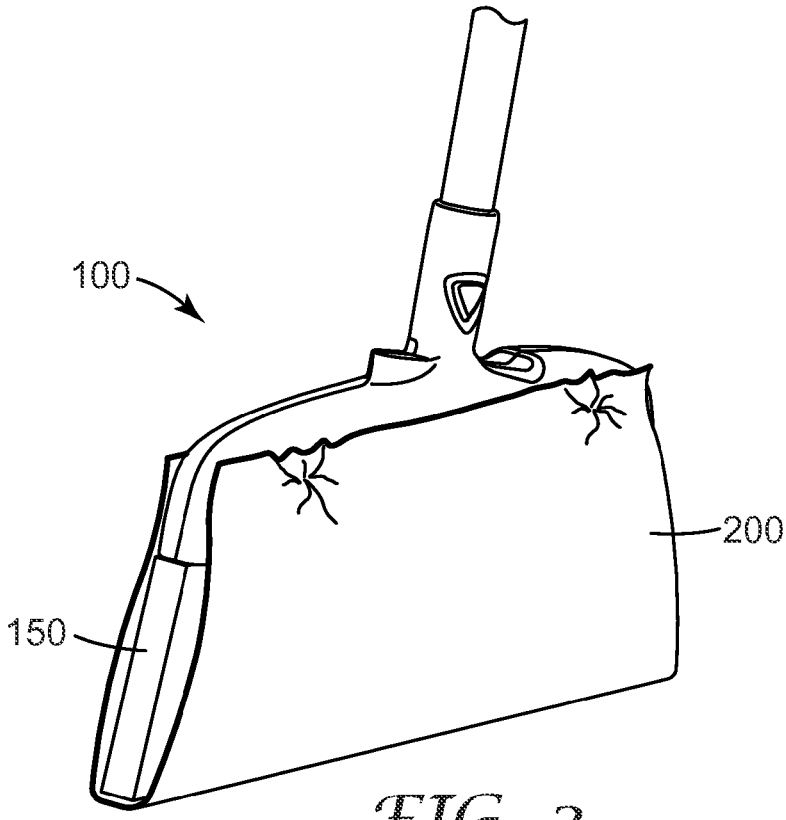
FIG. 2 is a perspective view of one embodiment of the floor cleaning implement of FIG. 1 with a capturing sheet over the wiping body.

FIG. 2 is a perspective view of one embodiment of the floor cleaning implement 100 of FIG. 1 with a capture sheet 200 over the wiping body 150. The capture sheet 200 connects to the attachment mechanism. In this embodiment, each end of the capture sheet 200 is held within securing grips 130 by a pinching force. The capture sheet 200 wraps around continuously over the first wiping side 152, the free end 156, and the second wiping side 154 of the wiping body 150. Therefore, remaining exposed for cleaning is a first pick-up surface 202 over the first wiping side 152 of the wiping body 150 and a second pick-up surface 204 over the second wiping side 154 of the wiping body 150.

The capture sheet 200 may be any type of cleaning sheet that can be applied over the wiping body and used for cleaning or wiping a surface. The capture sheet 200 may be reusable, disposable, or semi-disposable. The capture sheet 200 may wet or dry.

The capturing sheet 200 may be a film that is suitable for sliding over a surface or may be a woven, knitted, or nonwoven cloth formed from natural, synthetic, or a combination of natural and synthetic fibers or filaments. The capture sheet 200 may comprise a plurality of layers of materials.

In one embodiment, the capture sheet 200 is a nonwoven web. The nonwoven web can be prepared by any suitable melt forming or mechanical forming operation. For example, the nonwoven webs may be carded, spunbonded, spunlaced, melt blown, air laid, creped, or made by other processes as are known in the art. Preferred components for the capture sheet 200 include nonwoven webs made from one or more of a variety of thermoplastic polymers that are known to form fibers. Suitable thermoplastic polymers can be selected from polyolefins (such as polyethylenes, polypropylenes, and polybutylenes), polyamides (such as nylon 6, nylon 6/6, and nylon 10), polyesters (such as polyethylene terephthalate), copolymers containing acrylic monomers, and blends and copolymers thereof. Semi-synthetic fibers (such as acetate fibers), natural fibers (such as cotton), regenerated fibers (such as rayon), and other non-thermoplastic fibers can also be blended with the thermoplastic fibers. The fibers typically have a denier of from about 2 to about 32, more preferably from about 5 to about 15. The basis weight of the wiping member is preferably from about 10 to about 150 grams per square meter, and more preferably from about 15 to about 100 grams per square meter.

In one embodiment, the capture sheet 200 includes an adhesive such that the outwardly facing surfaces of the capture sheet 200, first pick-up surface 202 and second pick-up surface 204, are tacky. The adhesive may cover a portion of the capture sheet 200 or may cover essentially the entire capture sheet 200.

Suitable adhesives for use with the present invention include any that are capable of being tacky at room temperature, including both adhesives that are initially tacky and those that are initially non-tacky but which can be activated to become tacky. Suitable adhesives include any pressure-sensitive adhesives, including materials based on acrylates, silicones, poly-alpha-olefins, polyisobutylenes, rubber block copolymers (such as styrene/isoprene/styrene and styrene/butadiene/styrene block copolymers), styrene butadiene rubbers, synthetic isoprenes, natural rubber, and blends thereof. The pressure-sensitive adhesives may be coated from solvent, from water, radiation polymerized, or hot melt processed. These pressure-sensitive adhesives may or may not be crosslinked. Crosslinking can be done by well-known methods, including chemical, ionic, physical, or radiation-induced processes.

US patent application publication 2003-0171051 titled "A Wipe," discloses a wipe with an adhesive that may be used as the capture sheet 200 of the present invention. In this disclosure, the adhesive is recessed from the surface of the wipe to allow for gliding of the wipe. However, because the adhesive is near the working surface, the wipe is able to pick up and retain large amounts of small and large particles.

US patent application publication 2007-0136967 titled "Adhesive Wipe," discloses an adhesive cleaning sheet that may be used as the capture sheet 200 of the present invention. This disclosure includes spacing elements on the surface of the cleaning sheet to allow for gliding of the cleaning sheet but also includes the adhesive at the working surface of the cleaning sheet.

Including an adhesive, which is tacky, on the outwardly facing surfaces of the capture sheet greatly increases the ability of the capture sheet to both collect and retain dirt, dust, and debris. Recessing the adhesive from the surface of the capturing sheet, including spacing elements, or generally minimizing the actual amount of the adhesive at the outward surface of the capture sheet 200 allows for easy gliding of the sheet over the surface being cleaned.

To use the floor cleaning implement 100, a capture sheet 200 is applied over the wiping body 150 and secured by the attachment mechanism. Then, a user holds the handle and with a pulling or sweeping force glides the wiping body 150, covered by the capture sheet 200, over the surface being cleaned. The capture sheet 200 keeps the wiping body 150 clean, while gathering and retaining the debris. Also, because a repeating sweeping motion is used, particles typically do not become trapped between the wiping member 150 and the surface being cleaned, which can prevent scratching. The pulling motion of sweeping is also advantageous because debris can be pulled out of corners and away from walls instead of the pushing motion of moping where debris is pushed into corners.

Figure 3:
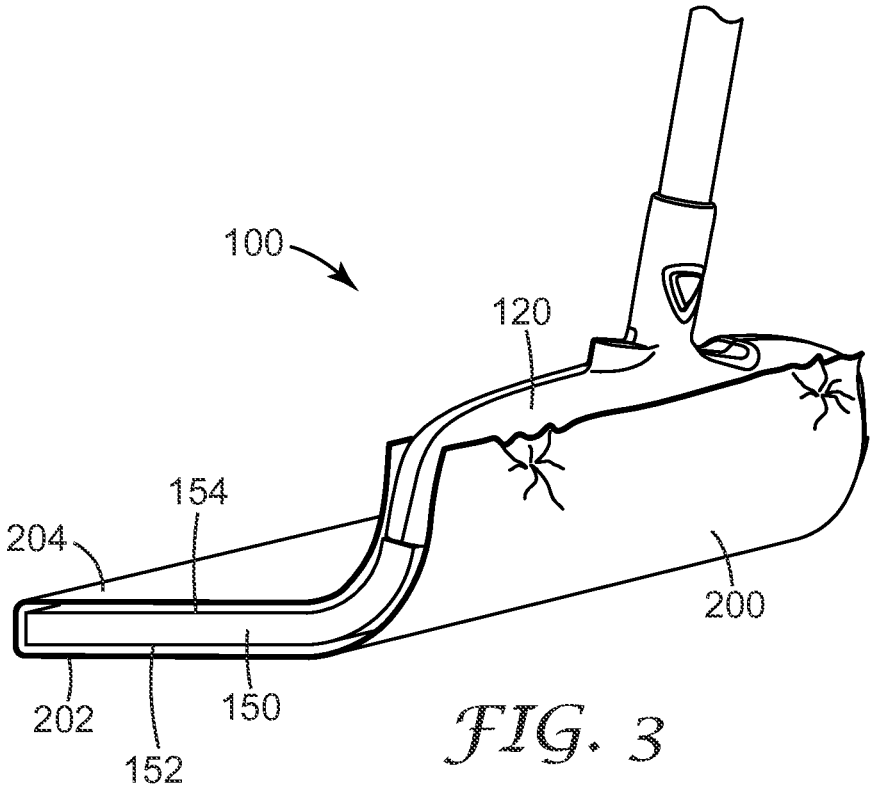
FIG. 3 is a perspective view of one embodiment of the floor cleaning implement of FIG. 2 flexed during use.

FIG. 3 is a perspective view of one embodiment of the floor cleaning implement 100 of FIG. 2 flexed during use. In embodiments where the wiping body 150 is flexible, pressure can be applied to the cleaning implement 100 to press the wiping body 150 towards the surface being cleaned, such as shown in FIG. 3. After the dirt, dust, and debris has been gathered, the wiping body 150 with the attached capture sheet 200 can be flexed to pick up the gathered dirt, dust, and debris.

The gathered debris could be swept into a dust pan. The capture sheet 200 is able to retain the fine dirt and dust that is often difficult to sweep into a dust pan.

In embodiments where the capture sheet 200 includes an adhesive, a large amount of dirt, dust, and debris can be captured and retained on the capture sheet 200. The adhesive can be included over the entire surface area of the capture sheet 200 or can be only in particular zones. For example, the adhesive may be included in a strip corresponding to the area surrounding the free end 156 of the wiping body 150 so that when the cleaning implement 100 is used in a sweeping action, the lower edge of the cleaning sheet retains the gathered debris. In another example, an adhesive section may be included in a more central area of the first pick-up surface 202, the second pick-up surface 204, or both so that when the wiping body 150 is flexed, like shown in FIG. 3, the adhesive surface makes contact and retains the gathered debris.

In some instances, the cleaning implement 100 may be glided across the surface being cleaned while being flexed, as shown in FIG. 3. In such instances, the cleaning implement 100 may be used similar to a dusting mop. In embodiments where the capture sheet 200 includes an adhesive, a large amount of dirt, dust, and debris can be captured and retained on the capture sheet 200.

The wiping body 150 with attached capture sheet 200 includes two pick-up surfaces to maximize the amount of available surface area for picking up, gathering and capturing dirt, dust, and debris. When one side is full of debris, the cleaning implement 100 may be rotated and the opposite side could be used.

In embodiments where the wiping body 150 is a sponge material, the cleaning implement can be used for cleaning up wet spills because the material of the wiping body 150 will absorb the liquid. In such an embodiment, the wiping body 150 is also suitable as a wet mop, where the material of the wiping body 150, the capture sheet 200, or both are wet when passed over the surface being cleaned.

In one embodiment, the cleaning implement includes a wiping body 150 that comprises a solid, continuous sponge material. Over the wiping body 150 is applied a capture sheet 200 that in one embodiment includes adhesive over essentially the entire surface area of the capture sheet 200. In this embodiment, one particularly suitable capture sheet 200 is a nonwoven cloth with an embedded adhesive.

In one embodiment, the cleaning implement includes a wiping body 150 that comprises bristles. Over the wiping body 150 is applied a capture sheet 200 that includes adhesive over essentially the entire surface area of the capture sheet 200. In this embodiment, one particularly suitable capture sheet 200 is a nonwoven cloth with an embedded adhesive.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

EXAMPLES

Pick-Up Test Method

Material removal was measured by distributing a measured amount (designated as $W_1$) of material on the surface of a 1.23 m×1.23 m vinyl floor. A sample of the capture sheet was attached to the wiping member of a cleaning implement. For the Comparative data, the Swiffer® dry cloth was attached and used in normal fashion on a Swiffer® flat mop. For the current invention the cleaning implement included a backing attached to a solid, continuous foam. The foam was G430 ether-based Polyurethane available from Wm. T. Burnett & Co. (durometer: Shore OO (35-40), length: 11 inches, thickness: 0.75 inch, height: 3.5 inches). The cleaning implement with the capture sheet attached was weighed and recorded as $W_2$.

The total debris ($W_1$) was divided into 3 even doses. The 1st dose was applied evenly over the test surface. For the Comparative data the cleaning head was moved back and forth across the test area and swiveled at each side. For the current invention the cleaning implement with the attached capture sheet was used in a sweeping action with just enough force applied to flex the wiping body as shown in FIG. 3. The cleaning implement was dragged across the surface making sure to lift the cleaning implement at each side and start again in such a way that the accumulated pile was pushed in the other direction. The entire surface was cleaned in this way and then again in the perpendicular direction. This procedure was repeated for doses 2 and 3. The cleaning implement was then weighed again ($W_3$).

The weight percent of the material removed by the wipe from the surface was calculated as follows:

$$\% \text{ Material Removed} = [(W_3 - W_2)/(W_1)] \times 100$$

Materials Removed from the Surface
Pet hair: 0.9 g applied (1-2 inch dog hair)
Crushed Cheerios Cereal: 0.75 g applied (0.125-1.4 mm)
Sand: 3.0 g applied (90-140 micron)
Dust: 2.0 g applied (JIS Test Powders 1, Class 7)
Sand/Dust: Combination 2.4 g sand (90-140 micron)/0.6 g (JIS Test Powder 1, Class 7)
Capture Sheet Nonadhesive capture sheet was a Swiffer® dry cloth available from Proctor & Gamble of Cincinnati, Ohio.

Adhesive capture sheet was an adhesive coated, nonwoven made with the following construction; carded nonwoven web (50% 15d PET, 30% 6d PET, 20% 4d Bicomponent Melty Fiber) and 17.5% continuous adhesive coating of RD-914 (water-borne solution, available from 3M Corporation)

| Example | Capture Sheet | Material | % Pick-Up |
|---|---|---|---|
| C-Example 1 | Nonadhesive | Pet Hair | 44% |
| C-Example 2 | Nonadhesive | Crushed Cheerios | 41% |
| C-Example 3 | Nonadhesive | Sand | 15% |
| C-Example 4 | Nonadhesive | Dust | 15% |
| C-Example 5 | Nonadhesive | Sand/Dust | 18% |
| Example 6 | Adhesive | Pet Hair | 92% |
| Example 7 | Adhesive | Crushed Cheerios | 87% |
| Example 8 | Adhesive | Sand | 99% |
| Example 9 | Adhesive | Dust | 72% |
| Example 10 | Adhesive | Sand/Dust | 92% |

What is claimed is:

1. A cleaning implement comprising:

a handle;

a wiping body connected at one end to the handle, wherein the wiping body includes a first wiping side and a second wiping side, opposite the first wiping side, wherein a length and width of the wiping body are each at least five times larger than a thickness between the first wiping side and second wiping side;

a capture sheet comprising a tacky surface, the capture sheet being sized and shaped to cover the wiping body by wrapping continuously around the first wiping side and second wiping side such that each of the first and second wiping sides are entirely covered by the capture sheet, wherein the tacky surface of the capture sheet is outwardly facing from the wiping body.

wherein the wiping body defines a free end opposite the handle, the free end extending between the first and second wiping sides, and further wherein the capture sheet wraps continuously around the first wiping side, the free end, and the second wiping side.

2. The cleaning implement of claim 1, wherein the wiping body comprises a flexible sponge block.

3. The cleaning implement of claim 1, wherein the wiping body can flex such that the first wiping side and second wiping side are parallel with the surface being cleaned.

4. The cleaning implement of claim 1, wherein the wiping body is a solid, continuous, and flexible material.

5. The cleaning implement of claim 4, wherein the length and width of the wiping body are at least 10 times larger than the thickness between the first wiping side and second wiping side.

6. The cleaning implement of claim 1, further comprising an attachment mechanism for securing the capture sheet when wrapped around the wiping body, wherein the attachment mechanism is configured to pinch the capture sheet.

7. The cleaning implement of claim 6, wherein the attachment mechanism includes a series of securing grips formed by a backing connecting the wiping body to the handle, and further wherein the capture sheet is attachable to the securing grips at any location along a length of the capture sheet.

8. The cleaning implement of claim 1, wherein the capture sheet includes a strip of adhesive arranged at an end of the wiping body opposite the handle and between the first and second wiping sides.

9. The cleaning implement of claim 1, wherein the capture sheet is removably wrapped around the first wiping side, the free end, and the second wiping side.

10. The cleaning implement of claim 1, wherein the handle includes a backing and wherein the wiping body is connected to the backing along the entire width of the end of the wiping body.

11. The cleaning implement of claim 1, wherein the wiping body is configured to flex along the planar surfaces of the first and second wiping sides.

12. A cleaning implement comprising:

a handle;

a wiping body connected at one end to the handle, wherein the wiping body includes a first wiping side and a second wiping side, opposite the first wiping side, wherein a length and width of the wiping body are each at least five times larger than a thickness between the first wiping side and second wiping side;

a capture sheet comprising a tacky surface, the capture sheet being sized and shaped to cover the wiping body by wrapping continuously around the first wiping side and second wiping side such that each of the first and second wiping sides are entirely covered by the capture sheet, wherein the tacky surface of the capture sheet is outwardly facing from the wiping body; and an attachment mechanism for securing the capture sheet when wrapped around the wiping body, wherein the attachment mechanism is configured to pinch the capture sheet.

13. The cleaning implement of claim 12, wherein the wiping body is a solid, continuous, and flexible material.

14. The cleaning implement of claim 12, wherein the length and width of the wiping body are at least 10 times larger than the thickness between the first wiping side and second wiping side.

15. The cleaning implement of claim 12, wherein the handle includes a backing and wherein the wiping body is connected to the backing along the entire width of the end of the wiping body.

16. A cleaning implement comprising:

a handle;

a wiping body connected at one end to the handle, wherein the wiping body includes a, first wiping side and a second wiping side, opposite the first wiping side, wherein a length and width of the wiping body are each at least five times larger than a thickness between the first wiping side and second wiping side;

a capture sheet comprising a tacky surface, the capture sheet being sized and shaped to cover the wiping body by wrapping continuously around the first wiping side and second wiping side such that each of the first and second wiping sides are entirely covered by the capture sheet, wherein the tacky surface of the capture sheet is outwardly facing from the wiping body;

wherein the handle includes a backing and wherein the wiping body is connected to the backing along the entire width of the end of the wiping body.

17. The cleaning implement of claim 16, wherein the wiping body is a solid, continuous, and flexible material.

18. The cleaning implement of claim 16, wherein the length and width of the wiping body are at least 10 times larger than the thickness between the first wiping side and second, wiping side.

* * * * *

UNITED STATES PATENT AND TRADEMARK OFFICE

CERTIFICATE OF CORRECTION

PATENT NO. : 8,549,690 B2
APPLICATION NO. : 13/001460
DATED : October 8, 2013
INVENTOR(S) : Vasilakes It is certified that error appears in the above-identified patent and that said Letters Patent is hereby corrected as shown below:

Title Page, Item [57], (Abstract)
Line 4 Before "comprised" delete "wiping body".

In the Specifications

Column 2
Line 6 Delete "fives time" and insert -- five times --, therefor.

Column 3
Line 20 Delete "than," and insert -- greater than, --, therefor.

Column 6
Line 12 (Approx.) Before "only" insert -- included --.

In the Claims

Column 8
Line 13 In Claim 1, delete "body." and insert -- body; --, therefor.

Column 9
Line 18 In Claim 16, delete "a," and insert -- a --, therefor.

Column 10
Line 18 In Claim 18, delete "second," and insert -- second --, therefor.

Signed and Sealed this
Fourth Day of February, 2014

Michelle K. Lee

Michelle K. Lee
*Deputy Director of the United States Patent and Trademark Office*